US007553137B2

(12) United States Patent
Kim

(10) Patent No.: US 7,553,137 B2
(45) Date of Patent: Jun. 30, 2009

(54) DISCHARGE VALVE ASSEMBLY OF RECIPROCATING COMPRESSOR

(75) Inventor: Young-Do Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 444 days.

(21) Appl. No.: 11/151,267

(22) Filed: Jun. 14, 2005

(65) Prior Publication Data

US 2006/0099091 A1 May 11, 2006

(30) Foreign Application Priority Data

Nov. 8, 2004 (KR) ..... 10-2004-0090394

(51) Int. Cl.
*F04B 53/10* (2006.01)

(52) U.S. Cl. ..... 417/570

(58) Field of Classification Search ..... 417/307, 417/311, 312, 569, 570; 136/529; 251/64
See application file for complete search history.

(56) References Cited

U.S. PATENT DOCUMENTS

| | | | | |
|---|---|---|---|---|
| 2,613,870 | A | 10/1952 | Borgerd | |
| 3,039,487 | A * | 6/1962 | Doeg | 137/516.11 |
| 3,489,334 | A * | 1/1970 | Garland | 417/569 |
| 3,508,849 | A * | 4/1970 | Weber | 417/454 |
| 4,627,464 | A | 12/1986 | Hartshorn | |
| 6,349,473 | B1 * | 2/2002 | Schmidt | 30/162 |
| 6,612,338 | B2 * | 9/2003 | Weldon et al. | 137/630.19 |
| 2003/0095881 | A1 * | 5/2003 | Hong | 417/561 |
| 2003/0206817 | A1 * | 11/2003 | Oh et al. | 417/417 |
| 2003/0221720 | A1 * | 12/2003 | Girouard | 137/74 |

FOREIGN PATENT DOCUMENTS

| | | | |
|---|---|---|---|
| FR | 2844838 | A1 | 3/2004 |
| KR | 2001-096179 | * | 11/2001 |
| KR | 10-2003-0054976 | A | 7/2003 |
| KR | 2003-054976 | * | 7/2003 |
| KR | 2004042000 | A * | 5/2004 |
| WO | WO-97/07334 | A1 | 2/1997 |
| WO | WO-2004/081379 | A2 | 9/2004 |

* cited by examiner

*Primary Examiner*—Charles G Freay
(74) *Attorney, Agent, or Firm*—Birch, Stewart, Kolasch & Birch, LLP

(57) ABSTRACT

A discharge valve assembly of a reciprocating compressor comprises: a discharge valve for opening or closing a compression space for compressing a refrigerant in a cylinder; a valve spring for elastically supporting the discharge valve as its one end is connected to the discharge valve; a discharge cover provided with a support surface connected to the valve spring, and covering an end of the cylinder, receiving the discharge valve and the valve spring and simultaneously forming a discharge space of a refrigerant; and a buffer member attached to an outer mounting surface of the cylinder, for lessening an impact by contacting with the discharge valve before the discharge valve comes in contact with the cylinder to close the compression space of the cylinder. The buffer member absorbs the amount of an impact before the discharge valve contacts with the cylinder, thereby minimizing noise generation.

14 Claims, 4 Drawing Sheets

DISCHARGE VALVE ASSEMBLY OF RECIPROCATING COMPRESSOR

BACKGROUND OF THE INVENTION

1. Field of the Invention

The present invention relates to a discharge valve assembly of a reciprocating compressor, and particularly, to a discharge valve assembly of a reciprocating compressor capable of minimizing noise generation and the amount of contact impact.

2. Description of the Background Art

In general, a reciprocating compressor is an apparatus that sucks and compresses a refrigerant gas as a piston linearly reciprocates in a cylinder. Such a reciprocating compressor is divided into two types according to the driving mechanism. Of the two types, one is that a rotating movement of a motor is converted into a linear reciprocation and the linear reciprocation is transferred to the piston, and the other one is that a linear reciprocation of the motor is directly transferred to the piston.

FIGS. 1 shows one example of a reciprocating compressor which is operated in such a manner that a linear reciprocation of a motor is directly transferred to a piston. As shown, the reciprocating compressor comprises: a casing 10 coupled to a gas suction pipe 1 and a gas discharge pipe 2; a front frame 20 and a middle frame 30 installed in the casing 10 at a predetermined distance therebetween and elastically supported; a driving motor 40 mounted between the front frame 20 and the middle frame 30, for generating a linearly reciprocating driving force; a cylinder 50 inserted in the first frame 20; a piston 60 linearly reciprocating in the cylinder 50 upon receiving a driving force of the driving motor 40; a rear frame 70 for covering the piston 60; a resonant spring 80 for elastically supporting the piston 60 to thereby induce resonance; a suction valve 90 coupled to a front end surface of the piston 60, for controlling the flow of a gas which is introduced into the cylinder 50 by the linear reciprocation of the piston 60; and a discharge valve assembly 100 installed at one side of the cylinder 50, for controlling discharging of a compressed gas which is compressed in the cylinder by the linear reciprocation of the piston 60.

The driving motor 40 includes: an outer stator 41 mounted between the front frame 20 and the middle frame 30; an inner stator 42 inserted in the outer stator 41 and mounted at the front frame 20; a winding coil 43 coupled to the outer stator 41; and a mover 44 installed between the outer stator 41 and the inner stator 42 to be linearly movable. The mover 44 includes a cylindrical holder 45 and a plurality of magnets 46 coupled to the holder 45, and the holder 45 is connected to the piston 60.

The discharge valve assembly 100 includes a discharge cover 101 for covering an inner space of the cylinder 50; a discharge valve 102 positioned in the discharge cover 101, for opening or closing the inner space of the cylinder; and a spring 103 for elastically supporting the discharge valve 102. The gas discharge pipe 2 is connected to the discharge cover 101.

Undescribed reference mark 104 is a coupling bolt, and 105 is a nut.

The operation of the reciprocating compressor having such a structure will now be described.

First, when power is applied to the compressor, a linearly reciprocating driving force is generated at the driving motor 40. Thus, the mover 44 of the driving motor linearly reciprocates, and a linearly reciprocating driving force of the mover 44 is transferred to the piston 60, so that the piston 60 linearly reciprocates in the inner space of the cylinder 50. By a pressure difference generated in the cylinder 50 due to a linear reciprocation of the piston 60 in the inner space of the cylinder 50, the suction valve 90 and the discharge valve assembly 100 open or close a gas passage, whereby a gas is sucked into, compressed in and discharged from the cylinder 50. The compressed gas discharged from the inner space of the cylinder 50 passes the inside of the discharge cover 101 and then is discharged through the gas discharge pipe 2. Such processes are continuously repeated to compress a gas.

Meanwhile, in the reciprocating compressor, the discharge valve assembly 100 for discharging a compressed gas according to a linear reciprocation of the piston 50 affects how much noise is generated. Also, the operation of the discharge valve assembly 100 affects flow resistance of a discharged gas, thereby affecting the amount of the discharged gas. Accordingly, researches on the discharge valve assembly 100 are very important in improving reliability and efficiency, and thus the researches thereon are actively ongoing.

FIG. 2 shows one example of a conventional structure of a discharge valve assembly of the reciprocating compressor. As shown, the discharge valve assembly 100 of the conventional compressor comprises: a discharge cover 101 for covering an inner space of the cylinder 50; a discharge valve 102 inserted in the discharge cover 101, for opening or closing the inner space of the cylinder 50; and a valve spring 103 for elastically supporting the discharge valve 102, wherein the discharge cover 101 is formed as a cap shape with a certain thickness. Namely, as for the discharge cover 101, a fixing portion 112 is bent and extends from one side of a cylindrical portion 111 having certain length and outer diameter, and is coupled to the front frame 20, and a discharge opening 113 to which the gas discharge pipe 2 is connected is formed at one side of the cylindrical portion 111.

The discharge valve 102 is formed as a circular compression plane 123 whose one side is coupled to a spring and whose other side blocks the inner space of the cylinder 50.

The valve spring 103 is a coil spring having a certain length.

One side of the valve spring 103 is coupled to the discharge valve, and its other side contacts with and is supported by an inner surface of the discharge cover. At this time, the compression plane 123 of the discharge valve comes in contact with a contact surface (S1), an end surface of the cylinder 50. And an inner surface of the discharge cover, which is in contact with the valve spring 103, is a plane parallel to the contact surface (S1) of the cylinder 50, which comes in contact with the compression plane 123 of the discharge valve.

The operation of the discharge valve assembly of the conventional reciprocating compressor having such a structure will now be described in detail.

First, when the piston 60 moves from a top dead point to a bottom dead point, the compression plane 123 of the discharge valve adheres to the contact surface (S1) of the cylinder 50 by a pressure difference of the inner space of the cylinder 50, and simultaneously, the suction valve 90 is opened, allowing a gas to be introduced into the inner space of the cylinder 50 through a passage formed in the piston 60.

And, when the piston 60 moves from a bottom dead point to a top dead point, the suction valve 90 blocks a gas passage of the piston 60, thereby gradually compressing the gas sucked in the inner space of the cylinder 50. When the gas reaches a set compression state, the discharge valve 102 supported by the valve spring 103 is opened, thereby discharging a compressed gas. By continuously repeating such processes, the gas is compressed.

In the discharge valve assembly having such a structure, a section of the inner space of the cylinder where a gas is compressed is a circular shape, and the discharge valve 102 for opening or closing the inner space is formed as a circular shape. Thus, the inner space of the cylinder 50 and the discharge valve 102 for opening or closing the inner space have the shapes which can allow a maximum discharge area. Therefore, the flow of a discharged gas is smooth, and a large amount of discharge gas is discharged at a time, thereby improving efficiency.

However, the discharge valve assembly having such a structure has the following problems. In order to make a movement of the discharge valve 102 smooth, stiffness of the valve spring 103 which elastically supports the discharge valve 102 is low. For this reason, when the discharge valve 102 moves, a range of the movement becomes wide, thereby increasing the amount of impact generated by contact with the cylinder 50. Accordingly, a valve contact noise of high frequency is greatly generated.

In addition, the discharge valve is opened when a force due to pressure of a compression space formed by the piston and the discharge valve is greater than the sum of an adhesive force of oil at the contact surface, a force due to a valve spring and a force due to pressure in the discharge cover. This makes the piston unnecessarily work on a fluid, thereby resulting in overcompression-related loss.

SUMMARY OF THE INVENTION

Therefore, an object of the present invention is to provide a discharge valve assembly of a reciprocating compressor capable of minimizing noise generation and the amount of contact impact.

To achieve these and other advantages and in accordance with the purpose of the present invention, as embodied and broadly described herein, there is provided a discharge valve assembly of a reciprocating compressor comprising: a discharge valve for opening or closing a compression space for compressing a refrigerant in a cylinder; a valve spring for elastically supporting the discharge valve as its one end is connected to the discharge valve; a discharge cover provided with a support surface connected to the valve spring, and covering an end of the cylinder, receiving the discharge valve and the valve spring and simultaneously forming a discharge space of a refrigerant; and a buffer member attached to an outer mounting surface of the cylinder, for lessening an impact by contacting with the discharge valve before the discharge valve comes in contact with the cylinder to close the compression space of the cylinder.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. Descriptions on the same details as those in the conventional art will be omitted.

Figure 1:
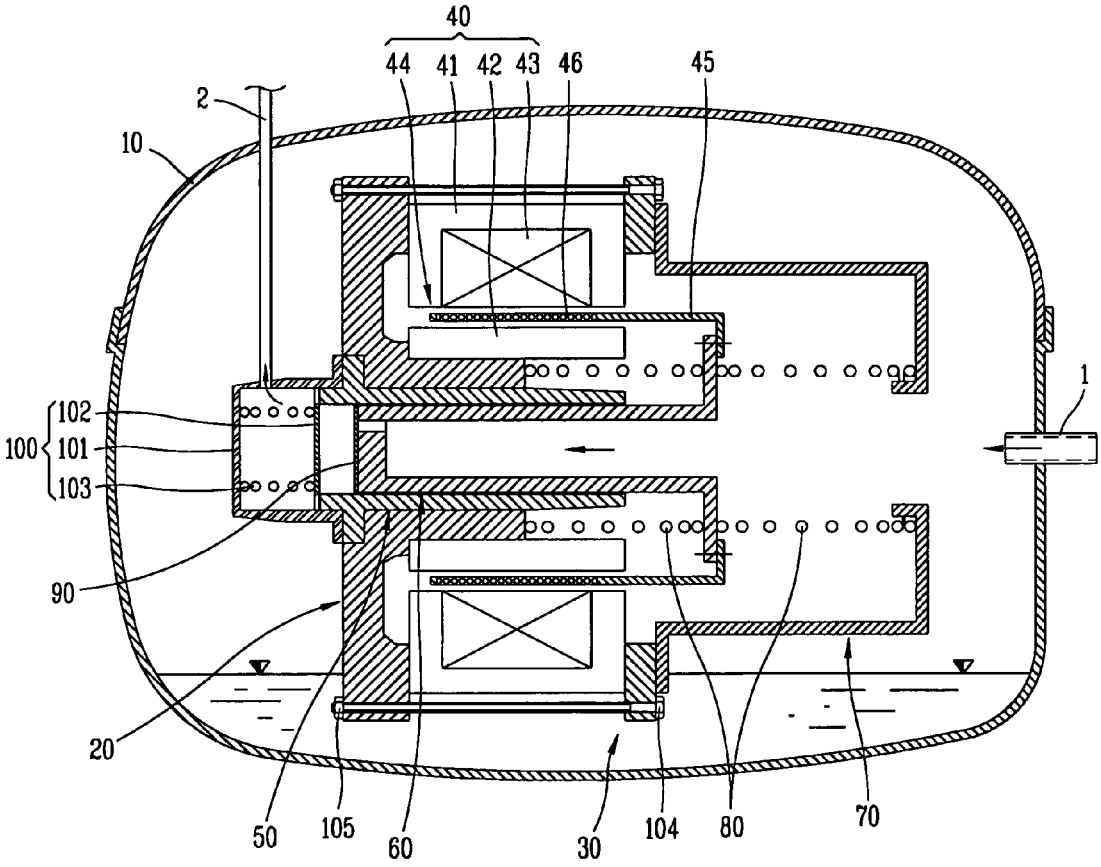
FIG. 1 CONVENTIONAL ART
FIG. 1 is a sectional view showing a conventional reciprocating compressor.
Figure 2:
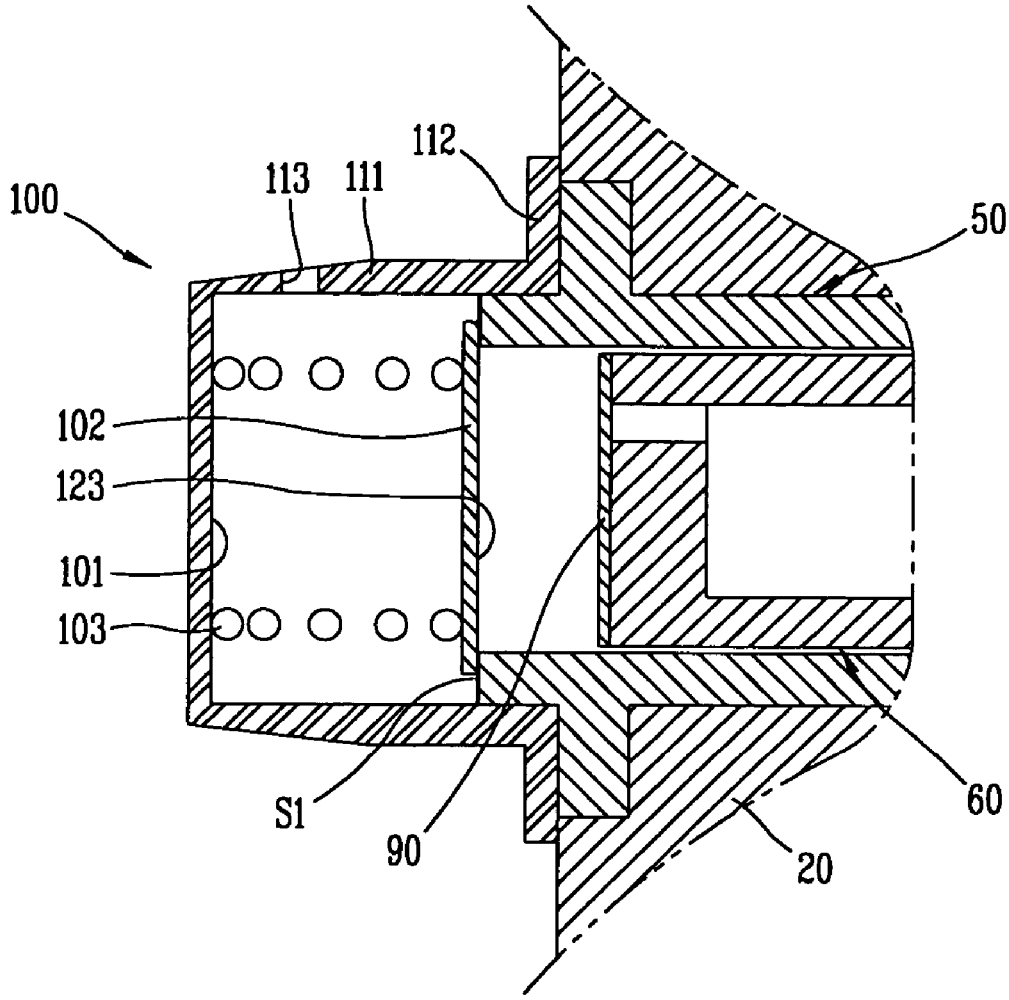
FIG.2 CONVENTIONAL ART
FIG. 2 is a sectional view showing a discharge valve assembly of the conventional reciprocating compressor.
Figure 3:
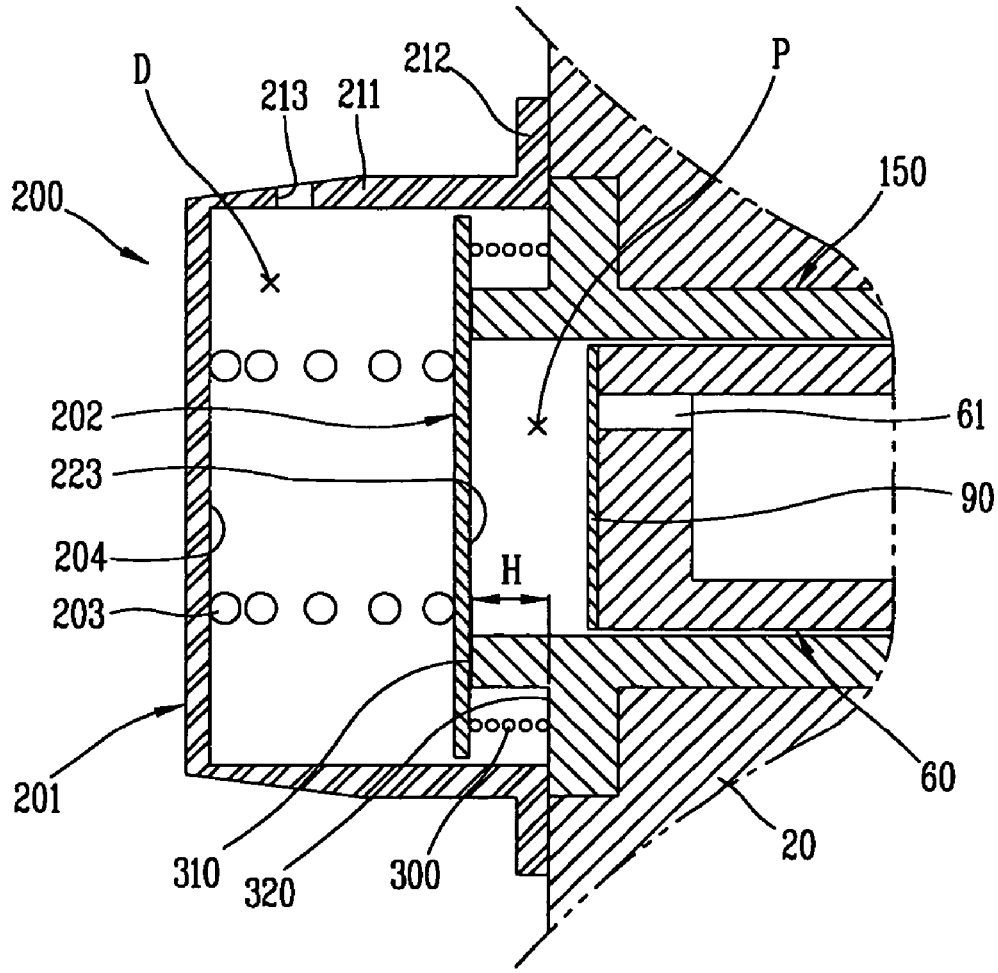
FIG. 3 is a sectional view showing a first embodiment of a discharge valve assembly of a reciprocating compressor in accordance with the present invention.

FIG. 3 is a sectional view showing a first embodiment of a discharge valve assembly of a reciprocating compressor in accordance with the present invention.

As shown, the discharge valve assembly 200 of the reciprocating compressor in accordance with the present invention includes: a discharge valve 202 for opening or closing a compression space (P) for compressing a refrigerant in a cylinder 150; a valve spring 203 elastically supporting the discharge valve 202 as its one end is connected to the discharge valve 202; a discharge cover 201 provided with a support surface 204 connected to the valve spring 203, for covering an end of the cylinder 150, receiving the discharge valve 202 and the valve spring 230 and forming a discharge space (D) of a refrigerant; and a buffer member 300 attached to an outer mounting surface 320 of the cylinder 150, for lessening an impact by coming in contact with the discharge valve 202 in advance before the discharge valve 202 contacts with the cylinder 150 to close the compression space (P) of the cylinder 150.

The cylinder 150 is supported by and installed at the front frame 20.

A piston 60 is inserted in the cylinder 150, and the piston 60 is coupled to a mover of a reciprocating driving motor within a compression space of the cylinder 150.

A step is formed at one side end of the cylinder 150, and a contact surface 310 contacting with the discharge valve 202 and a mounting surface 320 to which the buffer member 300 to be explained later is mounted are formed thereat.

A gas passage 61 is penetratingly formed in the piston 60, and a suction valve 90 for opening or closing the gas passage 61 is mounted at its one side end.

The discharge cover 201 is provided with a cylindrical portion 211 having a receiving space therein and formed as a cylindrical shape whose one side is opened, with certain thickness and length; and a fixing portion 212 bent and extending from the other side of the cylindrical portion 211. The fixing portion 212 is coupled to the front frame 20, so that the discharge cover 201 covers a portion including a contact surface 310 side of the cylinder. A discharge opening 213 for discharging a compressed refrigerant is formed at one side of the cylindrical portion 211. Like the conventional art, the discharge opening 213 is connected with a gas discharge pipe (not shown).

As for the discharge valve 202, its one side is a compression plane 223 contacting with the contact surface 310 of the cylinder, and a valve spring 203 is coupled to its other side. The discharge valve 202 contacts with the contact surface 310 of the cylinder with its compression plane 223 hermetically sealing the compression space (P) of the cylinder 150.

The valve spring 203 is a coil spring having a certain length.

As for the valve spring 203, its one side is coupled to the discharge valve 202, and the other side is in contact with and supported by the support surface 204 of the discharge cover 201. At this time, the compression plane 223 of the discharge valve contacts with the contact surface 310, an end surface of the cylinder 150, and the support surface 204 of the discharge cover, which is in contact with the valve spring 203, is a plane parallel to the contact surface 310 of the cylinder 150, which comes in contact with the compression plane 223 of the discharge valve.

The buffer member 300 is mounted to a mounting surface 320 of the cylinder 150.

Preferably, the buffer member 300 is formed to have a height higher than that (H) between the mounting surface 320 and the contact surface 310 by about 1 mm or higher in a state that the buffer member 30 does not receive any load. Namely, when closed, the discharge valve 202 preferably begins to contact with the buffer member 300 at a spot where a distance between the discharge valve 202 and the contact surface 301 is 1 mm or more.

Preferably, the buffer member 300 is one coil spring, and is mounted to a circumference of the mounting surface 320, or, as the buffer member 300, a plurality of coil springs may be disposed at the circumference of the mounting surface 320.

The buffer member 300 may be formed as a wave spring.

Also, the buffer member 300 may be formed by using an elastic material such as a sponge.

The mounting surface 320 is placed at a place where one side end of the cylinder 150 is stepped. Specifically, a protrusion of the stepped portion of the cylinder 150 becomes a contact surface 310 coming in contact with the compression plane 223 of the discharge valve 202, and a non-protrusion becomes a mounting surface 320 to which the buffer member 300 is mounted. A height (H) between the mounting surface 320 and the contact surface 310 may have a certain value, but the value may be zero. Namely, the mounting surface 320 and the contact surface 310 may be on the same plane. In such case, if a height of the buffer member 300 is set to be higher than 1 mm or more in a state that the buffer member 300 does not receive a load at all, the same effect as in the present invention would be achieved, provided a special means for fixing the buffer member 300 to one side of the cylinder 150 is installed.

The operational effect of the discharge valve assembly of the reciprocating compressor in accordance with the present invention will now be described.

The piston 60 linearly reciprocates in the cylinder 150 upon receiving a driving force of the driving motor. At this time, when the piston 60 moves from a bottom dead point to a top dead point, the suction valve 90 blocks a gas passage of the piston 60, thereby gradually compressing a gas sucked in the compression space (P) of the cylinder 150. If the gas reaches a set compression state, the discharge valve 202 supported by the valve spring 203 is opened, thereby discharging the compressed gas.

And, when the piston 230 moves from a top dead point to a bottom dead point, the compression plane 223 of the discharge valve 202 adheres to the contact surface 310 of the cylinder by a pressure difference of an inner space of the cylinder 150, and simultaneously, the suction valve 90 is opened, so that a gas is introduced into an inner space of the cylinder 150 through the gas passage. At this time, the buffer member 300 is positioned at the mounting surface 320, and a height of the buffer member 300 is higher than a height (H) at which one side of the cylinder protrudes from the mounting surface 320 to the contact surface 310. Therefore, the buffer member 300 comes in contact with the discharge valve 202 before the discharge valve 202 contacts with the contact surface 310, thereby distributing the amount of an impact. Namely, the buffer member 300 lessens an impact before the compression plane 223 of the discharge valve 202 contacts with the contact surface 310 of the cylinder.

By continuously repeating such processes, a gas is sucked, compressed and discharged.

Figure 4:
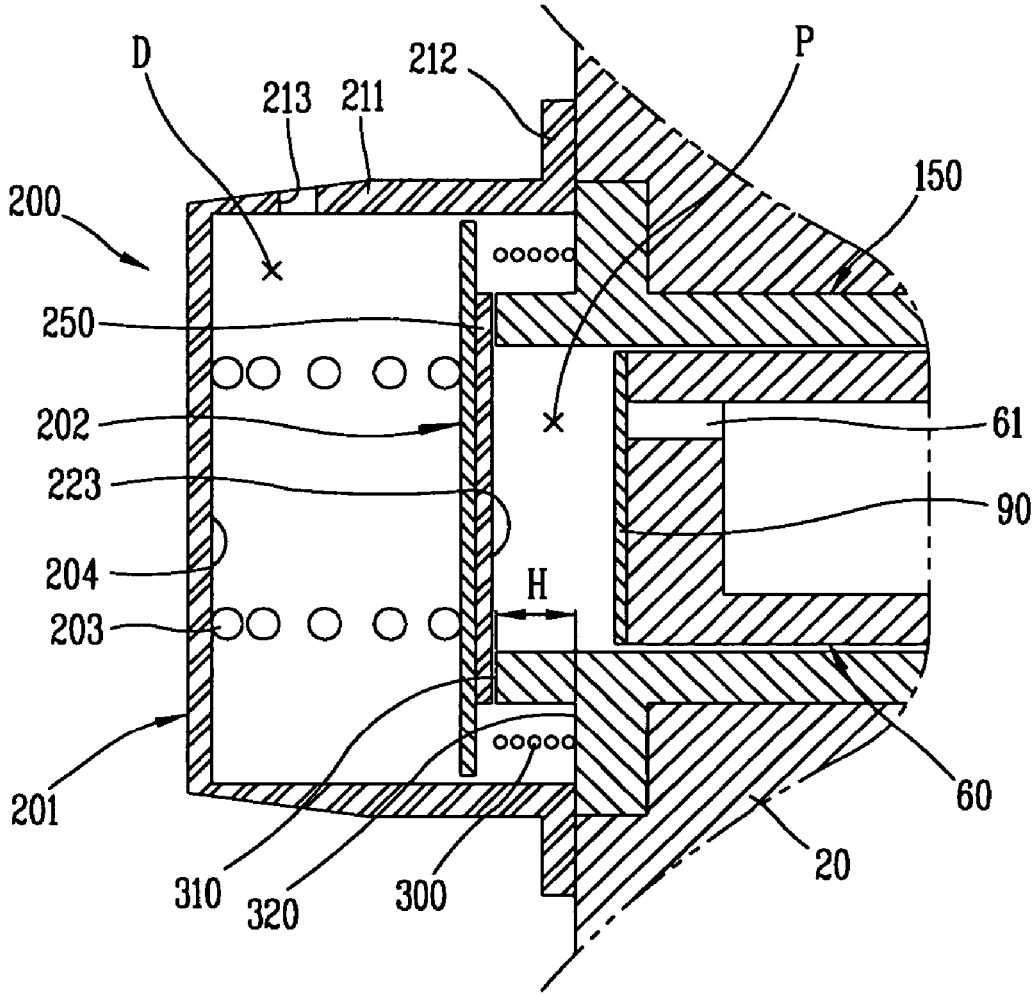
FIG. 4 is a sectional view showing a second embodiment of a discharge valve assembly of a reciprocating compressor in accordance with the present invention.

FIG. 4 is a sectional view showing a second embodiment of a discharge valve assembly of the reciprocating compressor in accordance with the present invention.

In case of the second embodiment, a discharge valve 202 is formed to be stepped, and, to this end, a contact member 250 is attached to the discharge valve 202 of the first embodiment, facing the piston 60. Preferably, an outer diameter of the contact member 250 is the same as that of the contact surface 310.

In the embodiment, the compression plane 223 is formed on the contact member 250, and the buffer member 300 contacts with the discharge valve 202, except its portion where the contact member 250 is placed. The contact member 250 is adjusted in thickness to control a distance between the buffer member 300 and the discharge valve 202, and is formed on the discharge valve 202.

As so far described, the discharge valve assembly of the reciprocating motor in accordance with the present invention is provided with a buffer member 300 for absorbing an impact by contacting with the discharge valve 202 before the discharge valve 202 comes in contact with the cylinder. Therefore, when the inner space of the cylinder 150 is opened or closed by a pressure difference generated by a reciprocation of the piston 60, the amount of an impact between the discharge valve 202 and the cylinder 150 is decreased, thereby reducing contact noise generation of the discharge valve 202 and improving reliability.

According to experiments, contact noise is desirably reduced by about 4 dB.

In addition, the discharge valve is opened when a force due to pressure of a compression space formed by the piston and the discharge valve is greater than the sum of an adhesive force of oil at the contact surface, a force due to a valve spring and a force due to pressure in the discharge cover. This makes the piston unnecessarily work on a fluid, thereby resulting in overcompression-related loss. However, the present invention is advantageous in that an overcompression-related loss can be reduced because the discharge valve is more easily opened by the buffer member, As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A discharge valve assembly of a reciprocating compressor comprising:

a discharge valve for opening or closing a compression space for compressing a refrigerant in a cylinder;

a valve spring for elastically supporting the discharge valve at one end is connected to the discharge valve;

a discharge cover provided with a support surface connected to the valve spring, and covering an end of the cylinder, receiving the discharge valve and the valve spring and simultaneously forming a discharge space of a refrigerant; and a buffer member attached to an outer mounting surface of the cylinder, for lessening an impact by contacting with the discharge valve before the discharge valve comes in contact with the cylinder to close the compression space of the cylinder, wherein one end of the cylinder is stepped, wherein a protrusion forms a contact surface contacting with the discharge valve and a non-protrusion forms the mounting surface on which the buffer member is mounted, and wherein the mounting surface is extendingly formed at an outer circumference of the contacting surface.

2. The assembly of claim 1, wherein a height of the buffer member, which is measured vertically from its mounting surface, is higher than that from the mounting surface to a contact surface on which the discharge valve and the cylinder contact with each other, by 1mm or higher.

3. The assembly of claim 1, wherein a height of the buffer member is 1mm or higher when measured vertically from a mounting surface, and the mounting surface and a contact surface on which the discharge valve contacts with the cylinder are positioned on the same plane.

4. The assembly of claim 1, wherein the buffer member is one coil spring.

5. The assembly of claim 1, wherein the buffer member is a wave spring.

6. The assembly of claim 1, wherein the buffer member is an elastic material.

7. The assembly of claim 1, wherein the buffer member is a sponge.

8. The assembly of claim 1, wherein the discharge valve further comprises:

a contact member attached toward the cylinder.

9. The assembly of claim 8, wherein an outer diameter of the contact member is the same as that of the contact surface on which the discharge valve contacts with the cylinder.

10. The assembly of claim 1, wherein the buffer member comprises a single spring completely encircling the protrusion of the cylinder.

11. The assembly of claim 10, wherein the spring is a coil spring.

12. The assembly of claim 1, wherein a contact portion between the discharge valve and the buffer member is located radially outwardly and spaced from a contact portion between the discharge valve and the contact surface of the protrusion.

13. The assembly of claim 1, wherein a diameter of the discharge valve is larger than a diameter of the protrusion of the cylinder.

14. The assembly of claim 1, wherein the buffer member comprises a single coil spring completely encircling the protrusion of the cylinder, wherein a diameter of the discharge valve is larger than a diameter of the protrusion of the cylinder, and wherein a contact portion between the discharge valve and the buffer member is located radially outwardly and spaced from a contact portion between the discharge valve and the contact surface of the protrusion.

* * * * *